US007686536B2

(12) United States Patent
Hall et al.

(10) Patent No.: US 7,686,536 B2
(45) Date of Patent: Mar. 30, 2010

(54) PAVEMENT DEGRADATION PISTON ASSEMBLY

(76) Inventors: David R. Hall, 2185 S. Larsen Pkwy., Provo, UT (US) 84606; David Wahlquist, 2185 S. Larsen Pkwy., Provo, UT (US) 84606; Neil Cannon, 2185 S. Larsen Pkwy., Provo, UT (US) 84606

( * ) Notice: Subject to any disclaimer, the term of this patent is extended or adjusted under 35 U.S.C. 154(b) by 468 days.

(21) Appl. No.: 11/844,447

(22) Filed: Aug. 24, 2007

(65) Prior Publication Data

US 2007/0290544 A1 Dec. 20, 2007

Related U.S. Application Data

(63) Continuation-in-part of application No. 11/421,105, filed on May 31, 2006, now Pat. No. 7,591,607, which is a continuation-in-part of application No. 11/379,643, filed on Apr. 21, 2006, now Pat. No. 7,641,418, which is a continuation-in-part of application No. 11/164,947, filed on Dec. 12, 2005, now Pat. No. 7,544,011, which is a continuation-in-part of application No. 11/163,615, filed on Oct. 25, 2005, now Pat. No. 7,473,052, which is a continuation-in-part of application No. 11/070,411, filed on Mar. 1, 2005, now Pat. No. 7,223,049.

(51) Int. Cl.
*E21C 25/00* (2006.01)
*E01C 23/088* (2006.01)

(52) U.S. Cl. ..... 404/94; 404/75; 299/41.1

(58) Field of Classification Search ..... 404/83–86, 404/93, 94, 75; 299/41.1
See application file for complete search history.

(56) References Cited

U.S. PATENT DOCUMENTS

| | | | | |
|---|---|---|---|---|
| 1,887,341 | A | | 11/1932 | Venable |
| 1,898,158 | A | | 2/1933 | Winkle |
| 2,039,078 | A | | 4/1936 | Hertwig |
| 2,098,895 | A | | 11/1937 | Velten |
| 2,633,782 | A | | 4/1953 | Clement |
| 2,893,299 | A | | 7/1959 | Moir |
| 2,908,206 | A | | 10/1959 | Melenson |
| 2,938,438 | A | | 5/1960 | Hamilton |
| 3,075,436 | A | | 1/1963 | McRae |
| 3,248,152 | A | * | 4/1966 | Henderson et al. ..... 299/41.1 |
| 3,360,298 | A | * | 12/1967 | Stoljarov et al. ..... 299/41.1 |
| 3,361,042 | A | | 1/1968 | Cutler |
| 3,732,023 | A | | 5/1973 | Rank |
| 3,817,644 | A | | 6/1974 | Matson |
| 3,970,404 | A | | 7/1976 | Benedetti |
| 3,989,401 | A | | 11/1976 | Moench |
| 4,018,540 | A | | 4/1977 | Jackson |
| 4,104,736 | A | | 8/1978 | Mendenhall |
| 4,124,325 | A | | 11/1978 | Cutler |
| 4,127,351 | A | | 11/1978 | Vural |

(Continued)

*Primary Examiner*—Raymond W Addie
(74) *Attorney, Agent, or Firm*—Tyson J. Wilde

(57) ABSTRACT

A pavement degradation machine has a motorized vehicle adapted to traverse a paved surface. At least one piston apparatus has a distal end and a proximal end, the proximal end adapted for attachment to an underside of the motorized vehicle and the distal end extending towards the paved surface and comprising a rotary bit. The piston apparatus has a shaft disposed within a sleeve. The sleeve is adapted for axial motion and the shaft is adapted for rotational motion independent of the sleeve.

20 Claims, 8 Drawing Sheets

U.S. PATENT DOCUMENTS 4,172,679 A 10/1979 Wirtgen
4,195,946 A 4/1980 Swisher
4,215,949 A 8/1980 Gabriel
4,261,669 A 4/1981 Sindelar
4,313,690 A 2/1982 Hojbjerg
4,335,975 A 6/1982 Schoelkopf
4,347,016 A 8/1982 Larsen
4,407,605 A 10/1983 Chiostri
4,473,320 A 9/1984 Register
4,534,674 A 8/1985 Cutler
4,594,022 A 6/1986 Jeppson
4,668,017 A 5/1987 Petersen
4,676,689 A 6/1987 Yant
4,692,350 A 9/1987 Clarke
4,784,518 A 11/1988 Cutler
4,793,730 A 12/1988 Butch
4,968,101 A 11/1990 Bossow
5,026,205 A 6/1991 Gorski
5,131,788 A 7/1992 Hulicsko
5,366,320 A 11/1994 Hanlon
5,470,131 A * 11/1995 Nolan et al. ..... 299/41.1
5,556,225 A 9/1996 Marino
5,765,926 A 6/1998 Knapp
5,791,814 A 8/1998 Wiley
5,947,636 A 9/1999 Mara
5,947,638 A 9/1999 Heims
5,951,561 A 9/1999 Pepper
6,122,601 A 9/2000 Swanson
6,158,920 A 12/2000 Malot
6,287,048 B1 9/2001 Hollon et al.
6,371,689 B1 4/2002 Wiley
6,551,018 B2 4/2003 Baker
6,577,141 B2 6/2003 Gandrud
6,623,207 B2 9/2003 Grubba
6,769,836 B2 8/2004 Llyod
6,799,922 B2 10/2004 Smith
6,846,354 B2 1/2005 Larsen

* cited by examiner

PAVEMENT DEGRADATION PISTON ASSEMBLY

CROSS REFERENCE TO RELATED APPLICATIONS

This application is a continuation-in-part of U.S. patent application Ser. No. 11/421,105, which was filed on May 31, 2006 now U.S. Pat. No. 7,591,607 and entitled Asphalt Recycling Vehicle. U.S. patent application Ser. No. 11/421,105 is a continuation-in-part of U.S. patent application Ser. No. 11/379,643 which was filed on Apr. 21, 2006 now U.S. Pat. No. 7,641,418 and entitled Method for Depositing Pavement Rejuvenation Materials into a layer of Aggregate. Application Ser. No. 11/379,643 is a continuation-in-part of Ser. No. 11/164,947 which was filed on Dec. 12, 2005 now U.S. Pat. No. 7,473,052 and entitled Apparatus for Depositing Pavement Rejuvenation Materials on a Road Surface. U.S. patent application Ser. No. 11/164,947 is a continuation-in-part of U.S. patent application Ser. No. 11/163,615 filed on Oct. 25, 2005 now U.S. Pat. No. 7,473,052 and entitled Apparatus, System, and Method for In Situ Pavement Recycling. U.S. patent application Ser. No. 11/163,615 is a continuation-in-part of U.S. patent application Ser. No. 11/070,411 filed on Mar. 1, 2005 now U.S. Pat. No. 7,223,049 and entitled Apparatus, System, and Method for Directional Degradation of a Paved Surface All of the above mentioned U.S. patent applications are herein incorporated by reference for all that they contain.

BACKGROUND THE INVENTION

Modern road surfaces typically comprise asphalt, macadam, concreter, or other bituminous material processed and applied to form a smooth paved surface. Where low quality pavement components are used, or where pavement components are improperly implemented or combined, the paved surface may deteriorate quickly, necessitating frequent maintenance and repair. Even under normal conditions, temperature fluctuations, weather, and vehicular traffic over the paved surface may result in cracks and other surface irregularities over time. Road salts and other corrosive chemicals applied to the paved surface, as well as accumulation of water in surface cracks, may accelerate pavement deterioration. In some cases, concrete roads may shift over time resulting in uneven roads which are often planed to restore a smooth surface.

U.S. Pat. No. 6,439,317 to Minotti, et al., which is herein incorporated by reference for all that it contains, discloses a device for breaking up a paved surface which attaches to a host transport, such as a skid steer or backhoe, having a hydraulic power supply and preferably comprises a closed hydraulic system which includes a regenerative and concentric type double hydraulic cylinder arrangement adjustably supported within a vertical frame. The cylinder is operably attached to a weight such that when fluid is pumped into a first chamber, a piston drives a rod, thereby lifting a weight while at the same time, the piston forces hydraulic fluid from a second chamber to the host. The piston separates the first chamber form the second chamber within the cylinder. Upon reaching a prescribed height, a valve is opened, allowing fluid to flow from the first chamber into the second chamber, thereby allowing the weight to drop rapidly under the influence of gravity. The inventive device for breaking a paved surface includes an adjustment system for adjusting the vertical position of the cylinder within the frame and a system for preventing operation of the device unless it is properly positioned above the surface for breaking.

U.S. Pat. No. 4,767,162 to Reed, III which is herein incorporated by reference for all that it contains, discloses a hydraulic system for a pavement cutting machine that controls the engagement and disengagement of a rotating blade with a pavement surface. A proportional-flow manual-release valve is arranged in series with a pressure-compensated maximum-flow control valve to allow a rapid raising of the blade and an initial relatively rapid lowering of the blade followed by a controllable slower blade descent.

BRIEF SUMMARY OF THE INVENTION

In one aspect of the present invention, a pavement degradation machine has a motorized vehicle adapted to traverse a paved surface. At least one piston apparatus has a distal end and a proximal end, the proximal end adapted for attachment to an underside of the motorized vehicle and the distal end extending towards the paved surface and comprising a rotary bit. The piston apparatus has a shaft disposed within a sleeve. The sleeve is adapted for axial motion and the shaft is adapted for rotational motion independent of the sleeve. The sleeve may comprise chrome while the shaft may comprise nitride.

The distal end of the piston apparatus may have a tapered threaded portion adapted for attachment to a cylindrical bit comprising a plurality of cutters adapted to degrade the paved surface. The shaft may be adapted to rotate the cylindrical bit, thus increasing the rate of degradation. A plurality of bearings intermediate the sleeve and the shaft rotationally supports the shaft. The plurality of bearings may comprise needle 9bearings. A seal may be positioned intermediate the distal and proximal ends of the piston apparatus and may be adapted to support the axial motion of the piston. The seal may be a bronze T-seal. A plurality of retaining rings may be fitted within grooves formed in the sleeve adjacent the seal and may be adapted to axially position the piston apparatus. A plurality of spacers may be disposed adjacent the plurality of retaining rings. The plurality of spacers may be beneficial in securing the bronze T-seal to the sleeve of the piston apparatus. An H-wiper seal may be disposed intermediate a plurality of retaining rings proximate the distal end of the piston apparatus; a spacer being disposed intermediate the H-wiper seal and a retaining ring. The H-wiper may restrict lubrication fluid from leaking from the piston apparatus.

A plurality of roller thrust bearings may be disposed proximate the proximal end of the piston apparatus may be adapted to take an axial load applied to the piston apparatus. The axial load may be caused by the force of the rotary bit against a paved surface. A spacer may be disposed intermediate the roller thrust bearing and a recessed portion of the shaft. A preload cap may be disposed on the proximal end of the piston apparatus; the preload cap being adapted to secure the shaft to the roller thrust bearing.

In some embodiments the shaft may have a plurality of splines formed near the proximal end of the piston apparatus, the shaft being adapted for attachment to a motor. In other embodiments, the shaft may have a polygonal geometry near the proximal end of the piston apparatus in which the shaft is adapted for attachment to a motor. A sensor may be disposed within the shaft and may be adapted to measure an axial position of the piston apparatus. In some embodiments, the sensor may be a Hall effect sensor.

DETAILED DESCRIPTION OF THE INVENTION AND THE PREFERRED EMBODIMENT

Figure 1:
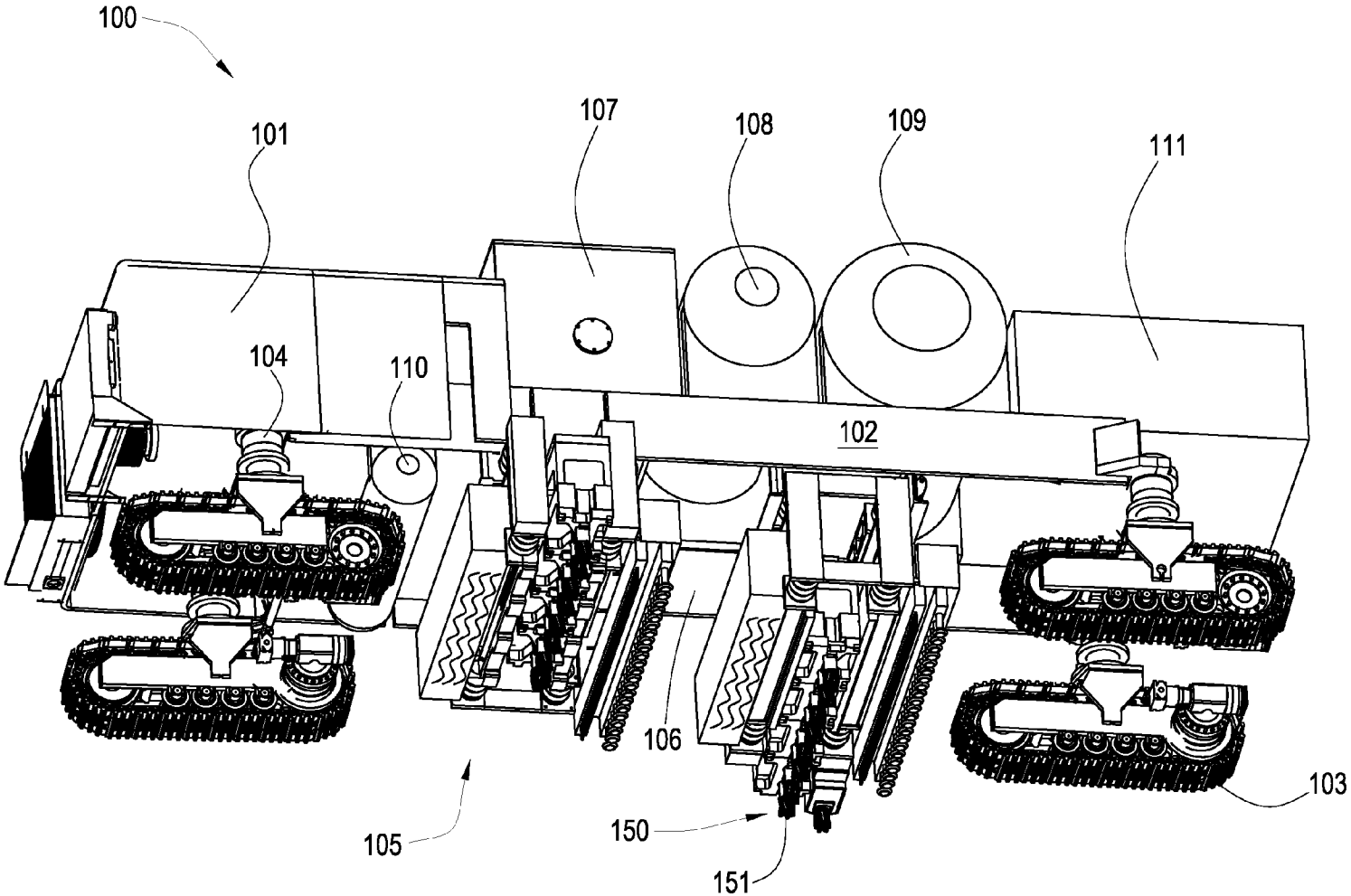
FIG. 1 is a perspective diagram of an embodiment of a pavement degradation machine.

FIG. 1 is a motorized vehicle 100 adapted to degrade and recycle a section of pavement. The motorized vehicle 100 may include a shroud 101, the shroud 101 covering various internal components of the motorized vehicle 100. The vehicle 100 may also include a frame 102 and a translation mechanism 103 such as tracks, wheels, or the like, to translate or move the vehicle 100. The pavement degradation machine 100 may also include means 104 for adjusting the elevation and slope of the frame 102 relative to the translation mechanism 103 to adjust for varying elevations, slopes, and contours of the underlying pavement. The vehicle 100 may include one or more slideable carriages 105 supported by a bearing surface of an underside 106 of the motorized vehicle 100. At least one piston apparatus 150 may be disposed within the carriages 105, the piston apparatus 150 being adapted for attachment to a cylindrical rotary bit 151 comprising a plurality of cutters adapted to degrade the paved surface. The rotary bit 151 is adapted for rotation by a portion of the piston apparatus 150.

In this application, "pavement" or a "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, sand, polyester fibers, Portland cement, petrochemical binders, or the like. The term "degrade" is used in this application to mean milling, grinding, cutting, ripping apart, tearing apart, or otherwise taking or pulling apart a pavement material into smaller constituent pieces. Similarly, the term "pavement constituents" is used to mean any materials or components used to create a paved surface, including new or reclaimed materials, or combinations thereof.

Under the shroud 101, the motorized vehicle 100 may include an engine and hydraulic pumps for powering the translational elements 103, the carriages 105, or other components. Likewise, the vehicle 100 may include a tank 107 for storing hydraulic fluid; a fuel tank 108; a tank 109 for storing rejuvenation materials such as asphalt, bitumen, oil, tar, or the like; a water tank 110; a hopper 111 for storing aggregate such as gravel, rock, sand, grit, pebbles, macadam, concrete, or the like; or any other storage containers. The vehicle 100 may also comprise a heating element connected to the underside 106 for heating the paved surface.

Figure 2:
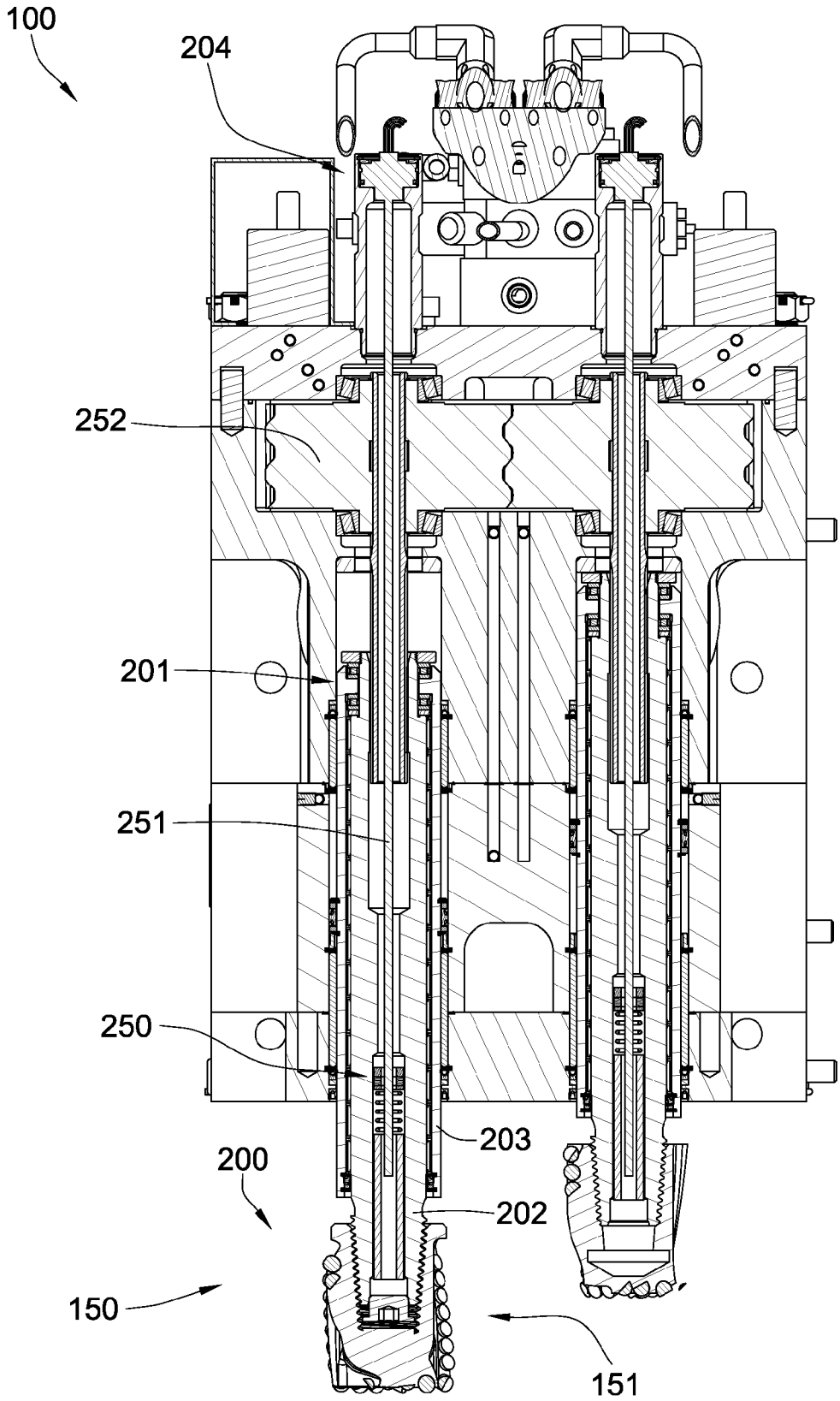
FIG. 2 is a cross-sectional diagram of an embodiment of a piston apparatus attached to a motorized vehicle.

Referring now to FIG. 2, at least one piston apparatus 150 has a distal end 200 and a proximal end 201, the proximal end 201 adapted for attachment to an underside of the motorized vehicle 100 and the distal end 200 extending towards the paved surface and comprising a rotary bit 151. In this embodiment, two piston apparatuses 150 may be positioned adjacent one another. In other embodiments, a plurality of piston apparatuses may be positioned in along a line parallel to the underside of the motorized vehicle. The piston apparatus 150 has a shaft 202 disposed within a sleeve 203. The sleeve 203 is adapted for axial motion whereas the shaft 202 is adapted for rotational motion independent of the sleeve 203. The shaft 202 may be adapted to rotate the cylindrical rotary bit 151. The proximal end 201 of the shaft 202 may comprise a plurality of splines such that the shaft 202 may be adapted for attachment to a motor 204. A plurality of gears 252 disposed intermediate the proximal end 201 of the piston apparatus 150 and the motor 204 may be adapted to rotate the shaft 202.

In the preferred embodiment, a sensor 250 may be disposed within the shaft 202 and may be adapted to measure an axial position of the piston apparatus 150. In the preferred embodiment, the sensor 250 may be a Hall effect sensor. This may be beneficial such that an ideal fluid pressure may be applied to the piston apparatus 150 based on the axial position of the piston apparatus 150. The sensor 250 may be in communication with a central rod 251; the central rod 251 remaining stationary as the piston apparatus 150 axially displaces during a pavement degradation operation.

Figure 3:
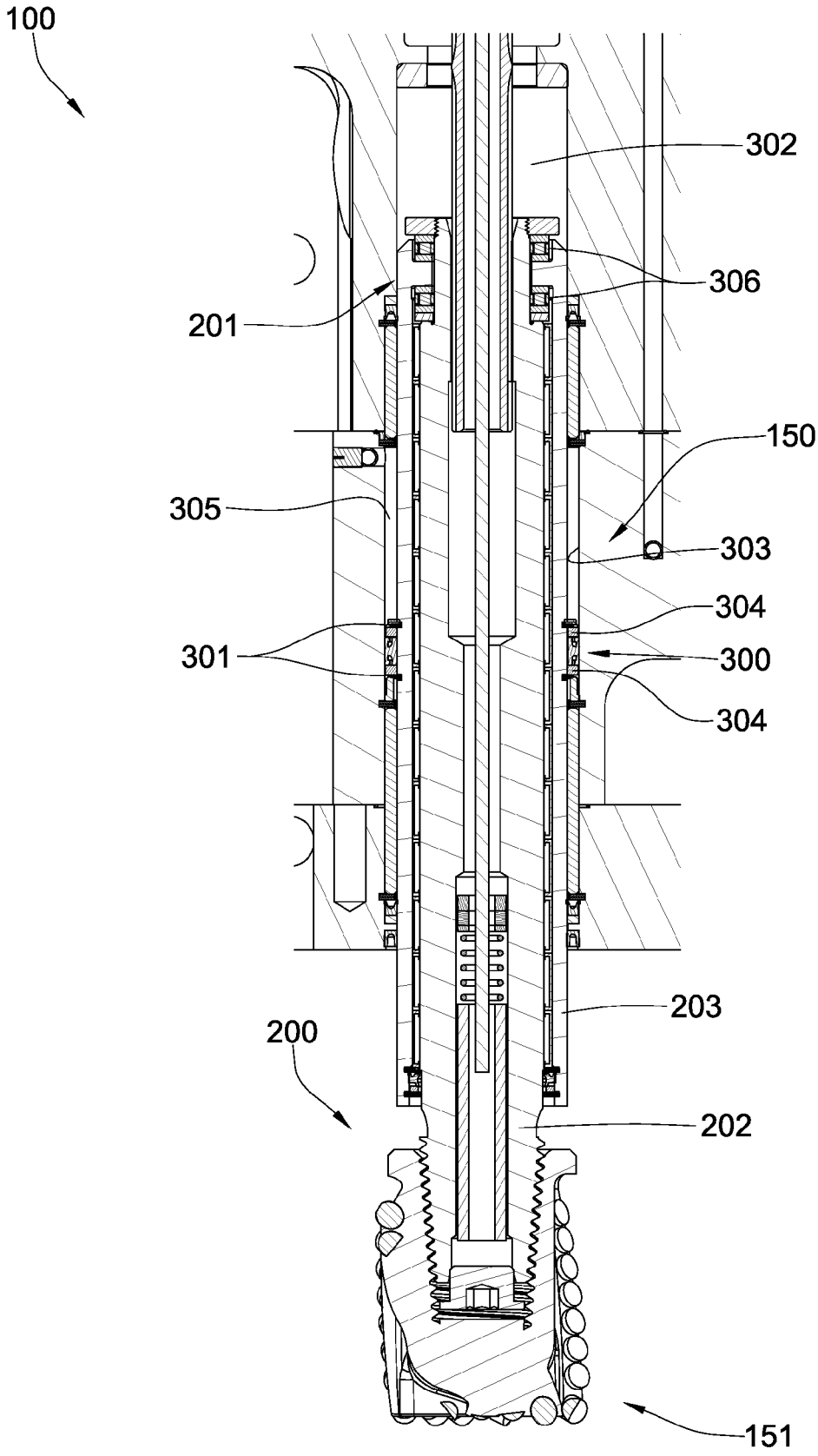
FIG. 3 is a cross-sectional diagram of an embodiment of a piston apparatus.

FIG. 3 illustrates a cross-sectional diagram of an embodiment of a piston apparatus 150 disposed within a motorized vehicle 100. In the preferred embodiment, the shaft 202 of the piston apparatus may be adapted to rotate the rotary bit 151. A seal 300 may be positioned intermediate the distal and proximal ends 200, 201, of the piston apparatus 150. The seal 300 may be adapted to support the axial motion of the piston 150. The seal 300 may comprise a bronze T-seal. A plurality of retaining rings 301 fitted within grooves formed in the sleeve 203 adjacent the seal 300 are adapted to axially position the piston apparatus 150. The piston apparatus 150 may fit into a pocket 302 formed in the motorized vehicle 100; the retaining rings 301 securing the seal 300 adjacent a wall 303 of the pocket 302. A plurality of spacers 304 disposed adjacent the plurality of retaining rings 301 may help to secure the seal 300 within the retaining rings 301. Fluid may pass into a chamber 305 intermediate the sleeve 203 and the wall 303 of the pocket 302. The increase in pressure may force the seal 300, and thereby the piston apparatus 150, in an axial direction toward the pavement. A portion of the axial load applied to the piston apparatus 150 may be taken by a plurality of roller thrust bearings 306 disposed proximate the proximal end 201 of the piston apparatus 150. In this embodiment, the piston apparatus 150 may be fully extended so that the rotary bit 151 applies the greatest force against a paved surface.

Figure 4:
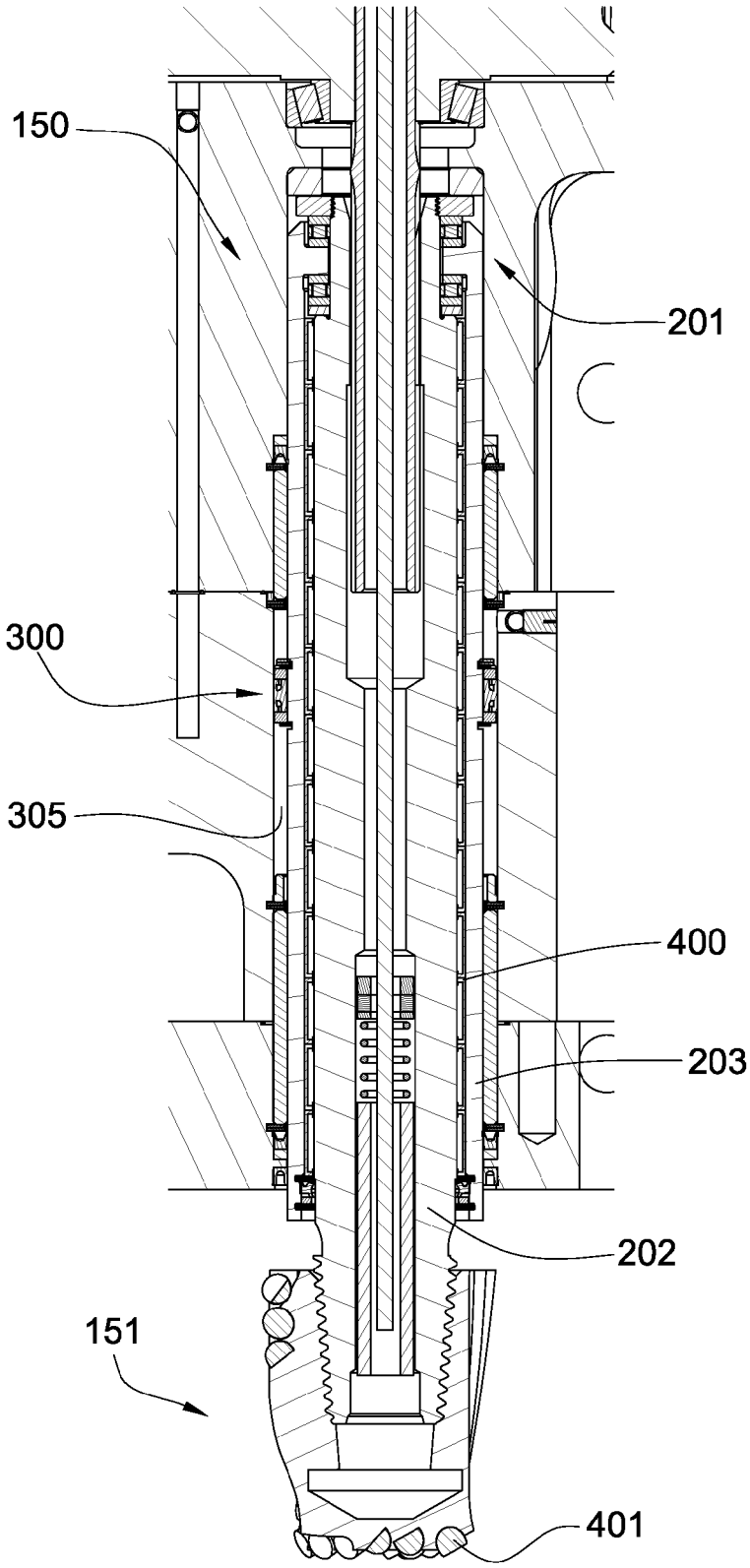
FIG. 4 is a cross-sectional diagram of another embodiment of a piston apparatus.

In the embodiment shown in FIG. 4, the piston apparatus 150 may be fully retracted. In this embodiment, fluid may cause a pressure b build up within the chamber 305 below the seal 300, resulting in an axial displacement of the piston apparatus 150 toward a motor attached near the proximal end 201.

Thus, it is believed that separating the rotational motion and the axial motion may prolong the life of the seal used to support the axial motion of the piston apparatus. In this embodiment, the shaft 202 may be adapted to rotate independent of the sleeve 203. A plurality of bearings 400 may be positioned intermediate the shaft 202 and the sleeve 203 so that during pavement degradation the shaft 202 may rotate, thus rotating the rotary bit 151, while the sleeve 203 remains rotationally stationary with respect to the pavement. The bearings 400 may comprise needle bearings. The rotary bit 151 may comprise a plurality of cutters 401 adapted to degrade the paved surface.

Figure 5:
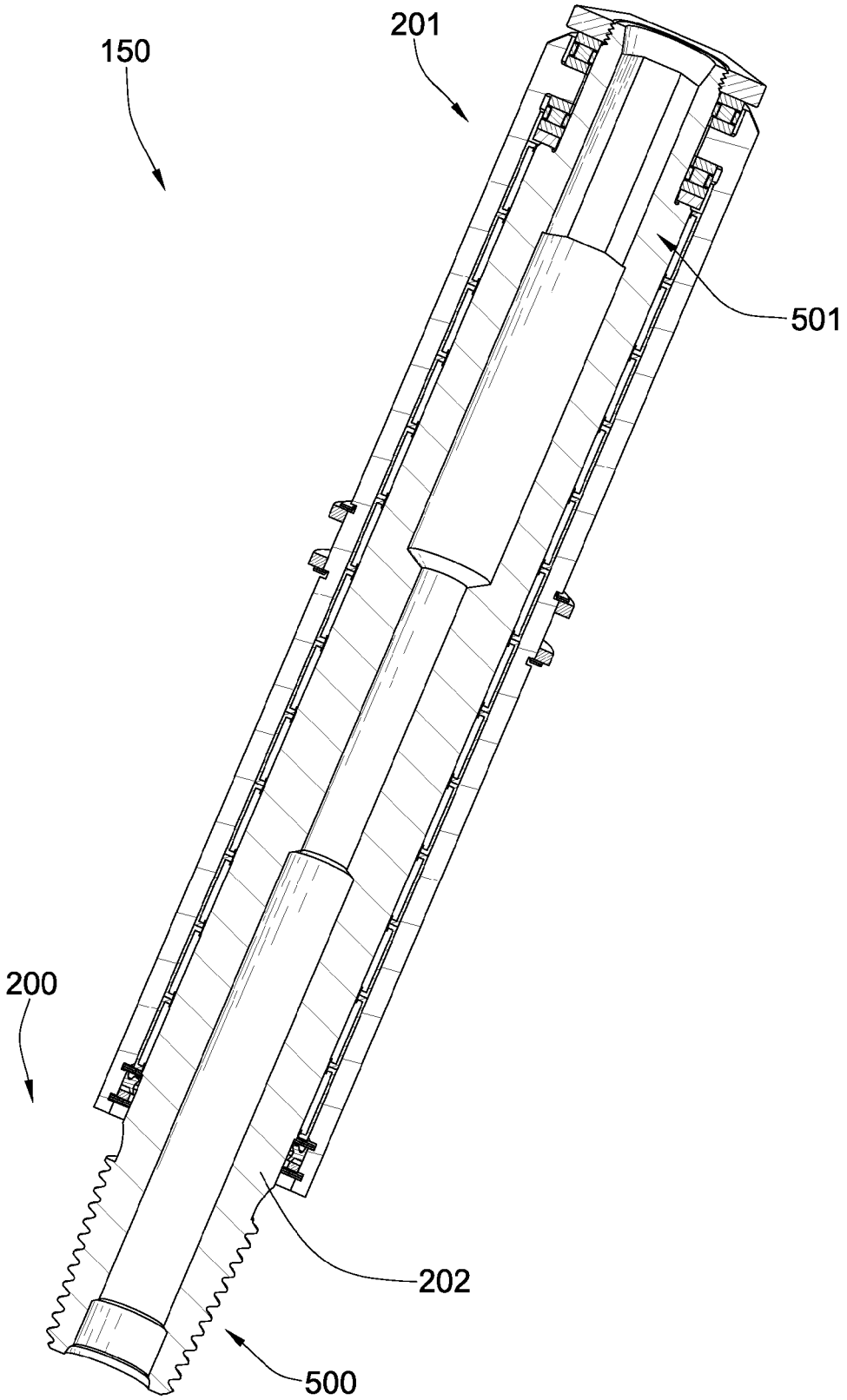
FIG. 5 is a cross-sectional diagram of another embodiment of a piston apparatus.

Referring now to FIG. 5, the distal end 200 of the piston apparatus 150 may have a tapered threaded portion 500 adapted for attachment to a rotary bit. In this embodiment, the shaft 202 may have a polygonal geometry 501 near the proximal end 201 of the piston apparatus 150. The polygonal geometry 501 of the shaft 202 may be adapted for attachment to a motor, the motor being adapted to rotate the shaft 202.

Figure 6:
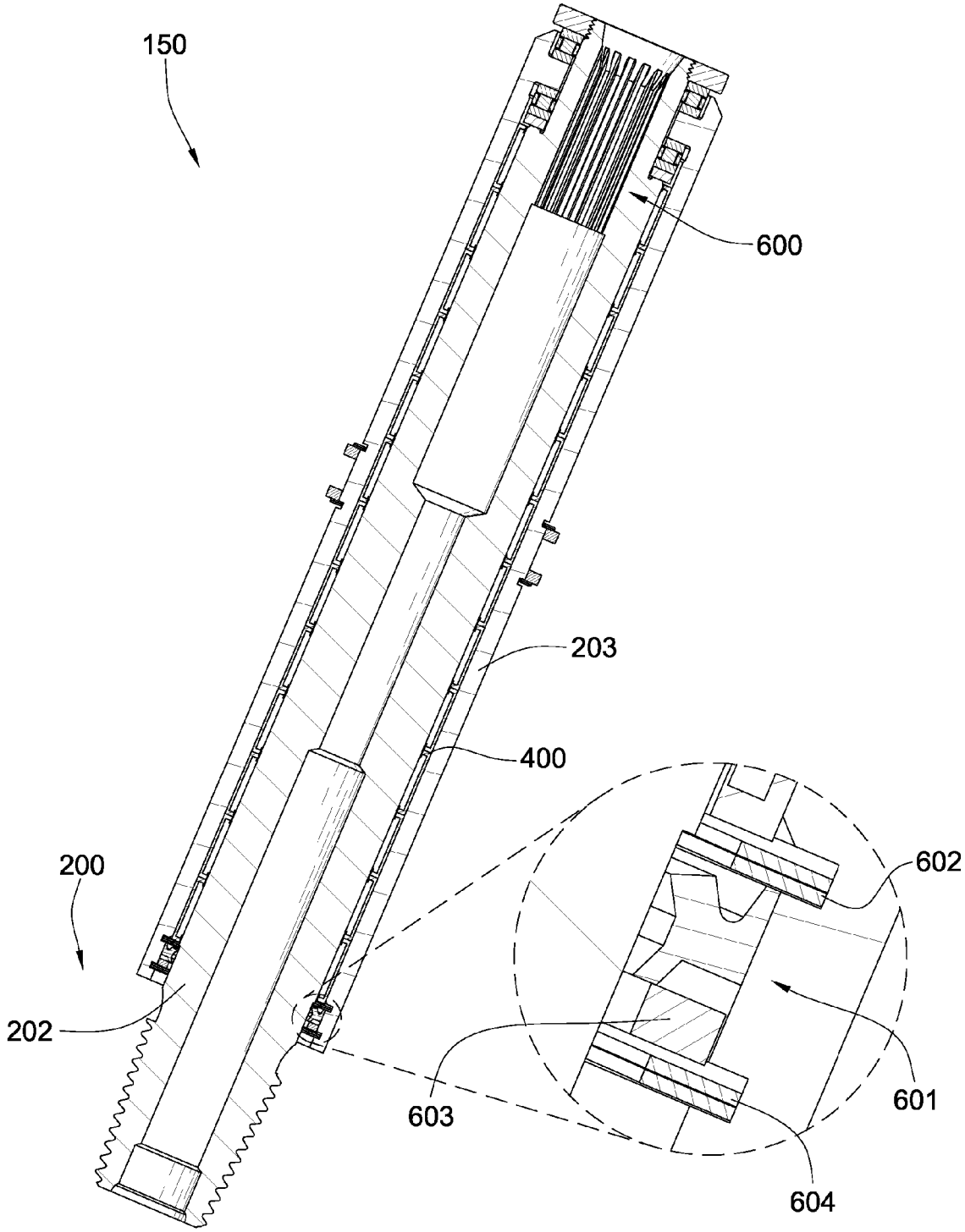
FIG. 6 is a cross-sectional diagram of another embodiment of a piston apparatus.

In the embodiment of FIG. 6, the shaft 202 may have a plurality of splines 600 formed near the proximal end of the piston apparatus 150, the shaft 202 being adapted for attachment to a motor. An H-wiper seal 601 may be disposed intermediate a plurality of retaining rings 602 proximate the distal end 200 of the piston apparatus 150. The H-wiper seal may be adapted to contain fluid used for the lubrication of the needle bearings 400 disposed between the shaft 202 and the sleeve 203. A spacer 603 may be disposed intermediate the H-wiper seal 601 and a retaining ring 604.

Figure 7:
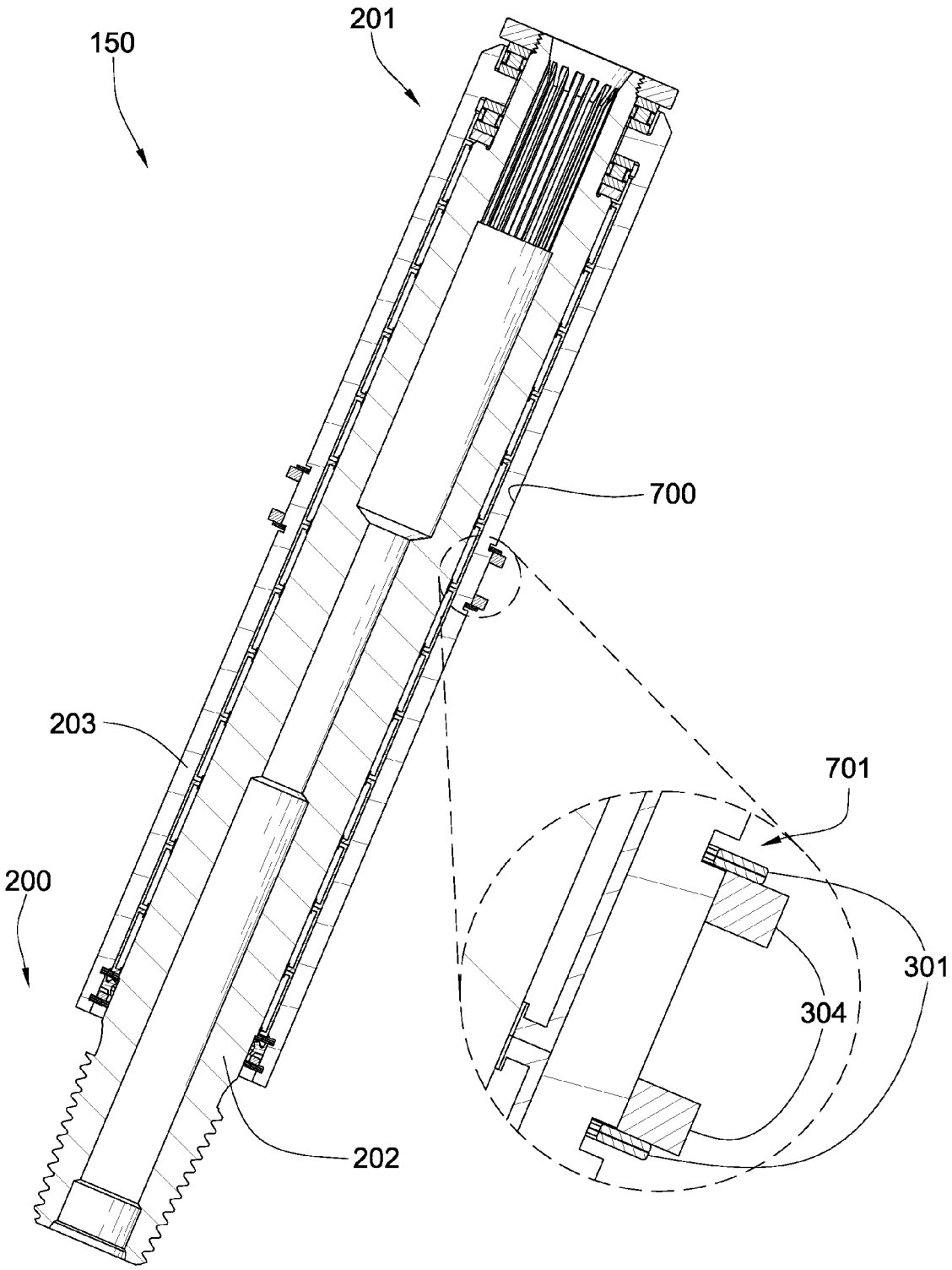
FIG. 7 is a cross-sectional diagram of another embodiment of a piston apparatus.

FIG. 7 illustrates a piston apparatus 150 with a shaft 202 disposed within a sleeve 203. An outer wall 700 of the sleeve 203 may comprise a plurality of retaining rings 301 fitted within grooves 701 intermediate the distal end 200 and the proximal end 201 of the piston apparatus 150. Spacers 304 may be positioned adjacent the retaining rings 301 and may be adapted to secure the piston apparatus 150 to a T-seal (not shown in this embodiment) such that the T-seal supports the axial motion of the piston apparatus.

Figure 8:
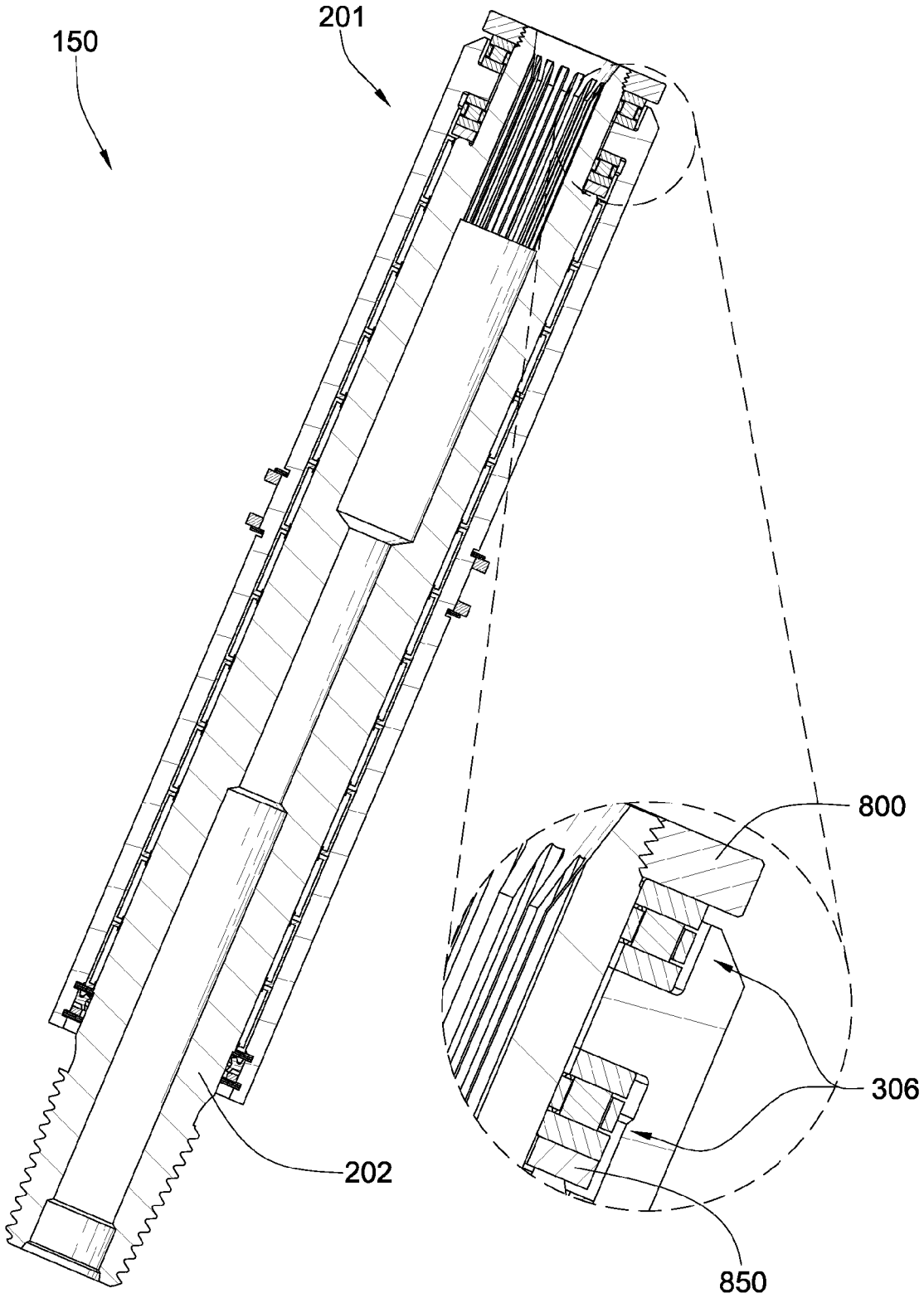
FIG. 8 is a cross-sectional diagram of another embodiment of a piston apparatus.

Referring now to FIG. 8, the proximal end 201 of the piston apparatus 150 may comprise a plurality of roller thrust bearings 306. The plurality of roller thrust bearings 206 may be adapted to take an axial load exerted on the piston apparatus 150 during operation. The load may be caused by the forces produced from the contact between the rotary bit and the paved surface being degraded. A spacer 850 may be disposed intermediate the roller thrust bearing 306 and a recessed portion of the shaft 202. In this embodiment, a preload cap 800 may be disposed on the proximal end 201 of the piston apparatus 150. The preload cap 800 may be adapted to secure the shaft 202 to the roller thrust bearings 306.

Whereas the present invention has been described in particular relation to the drawings attached hereto, it should be understood that other and further modifications apart from those shown or suggested herein, may be made within the scope and spirit of the present invention.

What is claimed is:

1. A pavement degradation machine, comprising:

a motorized vehicle adapted to traverse a paved surface;

at least one piston apparatus comprising a distal end and a proximal end, the proximal end adapted for attachment to an underside of the motorized vehicle and the distal end extending towards the paved surface and comprising a rotary bit;

the piston apparatus comprising a shaft disposed within a sleeve;

wherein the sleeve is adapted for axial motion and the shaft is adapted for rotational motion independent of the sleeve.

2. The machine of claim 1, wherein the distal end of the piston apparatus comprises a tapered threaded portion adapted for attachment to the rotary bit comprising a plurality of cutters adapted to degrade the paved surface.

3. The machine of claim 2, wherein the shaft is adapted to rotate the rotary bit.

4. The machine of claim 1, wherein a plurality of bearings intermediate the sleeve and the shaft rotationally supports the shaft.

5. The machine of claim 4, wherein the plurality of bearings comprises needle bearings.

6. The machine of claim 1, wherein a seal positioned intermediate the distal and proximal ends of the piston apparatus is adapted to support the axial motion of the piston.

7. The machine of claim 6, wherein the seal comprises a bronze T-seal.

8. The machine of claim 6, wherein a plurality of retaining rings fitted within grooves formed in the sleeve adjacent the seal are adapted to axially position the piston apparatus.

9. The machine of claim 8, wherein a plurality of spacers is disposed adjacent the plurality of retaining rings.

10. The machine of claim 1, wherein an H-wiper seal is disposed intermediate a plurality of retaining rings proximate the distal end of the piston apparatus.

11. The machine of claim 1, wherein a spacer is disposed intermediate the H-wiper seal and a retaining ring.

12. The machine of claim 1, wherein a plurality of roller thrust bearings disposed proximate the proximal end of the piston apparatus is adapted to take an axial load applied to the piston apparatus.

13. The machine of claim 12, wherein a spacer is disposed intermediate the roller thrust bearing and a recessed portion of the shaft.

14. The machine of claim 12, wherein a preload cap disposed on the proximal end of the piston apparatus is adapted to secure the shaft to the roller thrust bearing.

15. The machine of claim 1, wherein the shaft comprises a plurality of splines formed near the proximal end of the piston apparatus, the shaft being adapted for attachment to a motor.

16. The machine of claim 1, wherein the shaft comprises a polygonal geometry near the proximal end of the piston apparatus, the shaft being adapted for attachment to a motor.

17. The machine of claim 1, wherein the sleeve comprises chrome.

18. The machine of claim 1, wherein the shaft comprises nitride.

19. The machine of claim 1, wherein a sensor disposed within the shaft is adapted to measure an axial position of the piston apparatus.

20. The machine of claim 19, wherein the sensor is a Hall effect sensor.

* * * * *